United States Patent [19]

Mosley

[11] Patent Number: 4,785,478

[45] Date of Patent: Nov. 22, 1988

[54] SUN GLOVE

[76] Inventor: Austin W. Mosley, D-308 Petroleum Center, San Antonio, Tex. 78209

[21] Appl. No.: 127,688

[22] Filed: Dec. 2, 1987

[51] Int. Cl.[4] ..... A41D 19/00

[52] U.S. Cl. ..... 2/161 R; 2/161 A; 2/167; 2/170

[58] Field of Search ..... 2/161 R, 161 A, 162, 2/164, 167, 163, 159, 158, 170

[56] References Cited

U.S. PATENT DOCUMENTS

| | | | |
|---|---|---|---|
| 2,581,549 | 1/1952 | McGaugh | 2/161 R |
| 2,794,638 | 6/1957 | Risher et al. | 2/161 A |
| 4,176,839 | 12/1979 | Pinkus | 2/161 A X |
| 4,183,100 | 1/1980 | DeMarco | 2/164 |
| 4,355,424 | 10/1982 | McCoy, Jr. | 2/167 X |
| 4,470,251 | 9/1984 | Bettcher | 2/161 R X |

*Primary Examiner*—Peter Nerbun

*Attorney, Agent, or Firm*—Thomas E. Sisson

[57] ABSTRACT

A covering for the hand of a user comprising a sheath of material resistant to ultraviolet ray penetration. The sheath has a top side and a bottom side and an expansible opening at a wrist end adapted to receive the user's hand. A multiplicity of digit ringlets on the top side of the sheath at the distal end opposite the wrist end are adapted to receive the fingers and thumb of the user's hand so as to secure the covering to the hand. The underneath or bottom side of the sheath has an arcuated recessed portion with the top of the recessed portion near the wrist end of the sheath so as to expose the palm of the user's hand when the hand is received through the wrist opening and the fingers and thumbs are received into the digit ringlets.

1 Claim, 1 Drawing Sheet

SUN GLOVE

BACKGROUND OF THE INVENTION

This invention relates to a glove apparatus and more specifically to a glove designed to protect the top side of the user's hand from overexposure to the sun.

It is well known that continued exposure to the sun results in various skin irritations and eventually to possible skin cancers. Individuals whose employment requires them to be exposed to sunlight for long periods of time are particularly susceptible. Additionally, even individuals who participate in outdoor sporting activities can begin to experience problems with skin cancers as a result of their extended activities in the sunlight.

The use of various lotions and creams containing sun screening compositions has been a common means for providing protection to the skin, but one of the major disadvantages of the creams and lotions is that they are most often oil based and if the creams or oils come in contact with the palms of the hands or fingers, it causes considerable difficulty in grasping tools or sporting implements. Further, the insertion and removal of one's hands into his or her pockets effectively wipes off the external cream or lotion.

The use of the traditional glove with covering to the fingers and thumb, while providing protection from the sun, restricts or deminishes sensitivity in the digits and palm of the hands, and this can be a detriment to performance of operations requiring manual dexterity.

The present invention allows the user to have full operation of his or her hand including full sensitivity since neither the fingers, thumb or palm of the user's hand is covered. The user can pick up small, thin items and remove items from his pocket without having to remove the instant glove.

The present invention provides specific protection for the top side of the hand when the user is exposed to sunlight. The present invention may be made of any material which has ultraviolet sunlight resisting or protecting qualities.

SUMMARY OF THE INVENTION

The instant invention is a covering for the hand of the user who is exposed to ultraviolet rays from the sun. A sheath of material which is resistant to ultraviolet ray penetration has a wrist opening adapted to enable the user to insert his or her hand through the wrist opening. The sheath has a top side and a bottom side. The top side of the sheath at the distal end opposite the wrist end has a multiplicity of digit ringlets which are adapted to receive the fingers and thumb of the user's hand so as to secure the covering on the user's hand. On the bottom side of the sheath there is an arcuated recess curving or extending toward the wrist end of the sheath so as to expose the palm of the user's hand. Thus, while the top side of the user's hand is protected from ultraviolet rays, the user has full use of his digits, thumb and palm without any reduction in the sensitivity of the user's hand.

DETAILED DESCRIPTION OF THE PREFERRED EMBODIMENT

Figure 1:
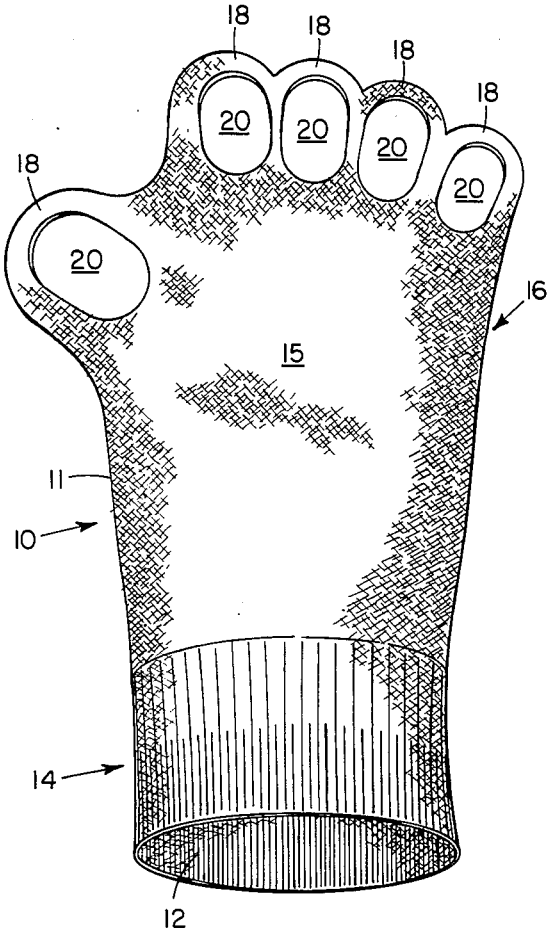
FIG. 1 is a perspective top view of the present invention.

FIG. 1 illustrates a top perspective view of the present invention 10. As can be seen in FIG. 1, the covering 10 is a sheath 11 of material resistant to ultraviolet ray penetration and has an expansible opening 12 at the wrist end 14 of the sheath 11. At the distal end 16 of the sheath 11 are a multiplicity of digit ringlets 18 having openings 20 through which a user may insert his or her fingers after the hand passes through the opening 12 at the wrist end 14 of the sheath 11. These digit ringlets 18 are connected to the top side 15 of sheath 11.

Figure 2:
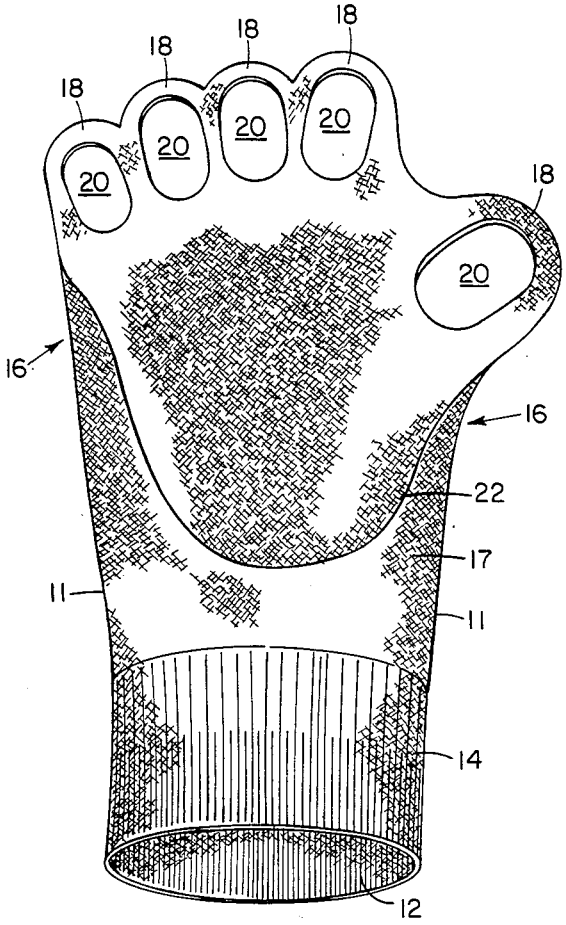
FIG. 2 is a perspective bottom view of the present invention.

FIG. 2 illustrates the underside 17 of sheath 11 showing that the underside 17 has an arcuated recesses portion 22 extending along underside 17 from the distal end 16 toward the wrist end 14 and curving back toward the digit ringlets on the distal end to form recess 22 so as to expose the palm of the user's hand when the user's fingers are inserted through openings 20 in ringlets 18.

As shown in FIGS. 1 and 2, wrist portion 14 is expansible so as to hold more securely to the user's wrist and insure that the glove is not displaced during movement of the hand.

It is preferred that the ringlets 18 are constructed so that the covering 10 may be worn on either the right hand or the left hand. If in construction, it is desired that the ringlet for the thumb should be somewhat larger and placed somewhat below than the ringlets for the fingers, the interchangeability of the covering between the right hand and the left hand is accomplished by merely turning the covering inside out whereby the thumb opening is thereby switched to the opposite side.

Figure 3:
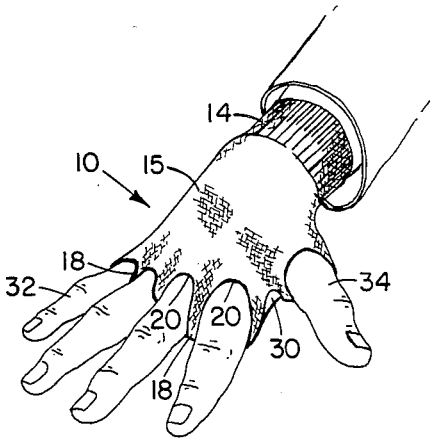
FIG. 3 is a perspective view of the present invention covering the hand of a user.

FIG. 3 illustrates a top side perspective view of the covering 10 on the hand 30 of the user. As can be seen in FIG. 3, wrist portion 14 is expanded over the wrist of the user securing covering 10 to the user's hand. The user's fingers 32 are extended through openings 20 in ringlets 18 further securing the covering 10 to the hand 30. As can be further seen in FIG. 3, the top side of the user's hand is protected from ultraviolet ray penetration. The fingers 32 and thumb 34 of the user's hand 30 are fully exposed for enabling the us r to have full sensitivity of the digits during the wearing of the covering 10.

Figure 4:
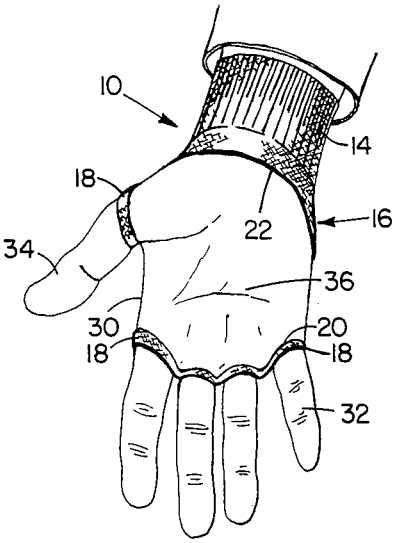
FIG. 4 is an underside perspective view of the hand of a user wearing the present invention exposing the palm of the user's hand.

FIG. 4 shows the underside of the user's hand with the covering 10 allowing exposure of the palm 36 of the user's hand 30. Again, ringlet 18 allows the user's fingers 32 and thumbs 34 to pass through openings 20 in ringlets 18 to secure the covering 10 to the user's hand. Wrist portion 14 is shown expanded around the user's wrist. Arcuated recessed portion 22 is shown extending from the distal end 16 of the underside of glove 10 back toward the wrist portion 14 thereby exposing the user's palm 36 so that the user has full usage of his palm, thumb, and fingers.

Sheath 11 may be constructed of almost an fabric material which allows for the material to "breathe" but which also protects the top of the hand from exposure to ultraviolet rays. Some recent innovations in fabric technology have resulted in the production of materials which do breathe but which have very tight weaves thereby reducing the amount of ultraviolet penetration through the fabric.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A covering for the hand of a user comprising:

a sheath of material which reduces ultraviolet ray penetration having a top side and a bottom side and an expansible opening at a wrist end adapted to receive said user's hand;

a multiplicity of digit ringlets on said top side of said sheath at a distal end opposite said wrist end, said ringlets adapted to receive and extend along the base of the fingers and thumb of said user's hand so as to secure said covering to said user's hand, said ringlets further adapted to substantially fully expose said user's fingers, thumb, and palm, said bottom side of said sheath having an arcuated recessed portion with the top of said recessed portion near said wrist end of said sheath so as to fully expose the palm of said user's hand.

* * * * *